United States Patent [19]

Van Rijn

[11] 3,948,210

[45] Apr. 6, 1976

[54] CAP FOR A FLAG POLE

[76] Inventor: Antoon J. Van Rijn, Hertog van Beierenstraat 7, Ter Aar, Netherlands

[22] Filed: Apr. 23, 1974

[21] Appl. No.: 463,396

[30] Foreign Application Priority Data

Apr. 26, 1973 Netherlands ..... 7305856

[52] U.S. Cl. ..... 116/173

[51] Int. Cl.[2] ..... G09F 17/00

[58] Field of Search ..... 206/405 R; 220/4 E; 116/173 R, 174; 254/190 R, 188; 161/32 R; 52/300, 301; 285/66, 418; 273/58 B

[56] References Cited

UNITED STATES PATENTS

| | | | |
|---|---|---|---|
| 1,851,404 | 3/1932 | Rose | 116/173 |
| 2,270,753 | 1/1942 | Fikes | 116/173 |
| 2,345,621 | 4/1944 | Mothershead | 116/173 |
| 2,971,206 | 2/1961 | Linn | 116/173 |
| 3,310,026 | 3/1967 | Baird, Jr. | 116/173 |
| 3,420,013 | 1/1969 | Alvarado | 52/301 |
| 3,433,203 | 3/1969 | Sharkey et al. | 116/173 |

FOREIGN PATENTS OR APPLICATIONS

| | | | |
|---|---|---|---|
| 71,533 | 10/1893 | Germany | 116/173 |

*Primary Examiner*—Robert J. Spar
*Assistant Examiner*—Kenneth Noland
*Attorney, Agent, or Firm*—Synnestvedt & Lechner

[57] ABSTRACT

A molded cap for a flag pole formed of counterpart partially hollow elements adhered together along their rims, to form a shape, preferably of revolution. Mating cores may be formed in opposite elements guiding a halyard over a molded block or sheath. The lower element has a central arbor which extends through it tapering inwardly and upwardly, and the upper element has a similar arbor, coaxially located, which terminates at the inner surface of the upper element. Resilient extensions rooted in the arbor and projecting downwardly from the cap may be used to secure it at the top of the flag pole.

7 Claims, 4 Drawing Figures

CAP FOR A FLAG POLE

This invention relates to a cap for a flag pole, which is provided with an opening for the mounting thereof onto the flag pole.

Such caps are generally known. They often consist of a body of rotation from wood formed on a lathe and in which there is a central opening extending upwards from the bottom face, by which opening it is possible to mount the cap on the top of the flat pole by introducing this top into said opening. The opening usually has a somewhat smaller diameter than the top of the pole and the top of the pole is usually made somewhat conical in shape, so that it is possible to hammer the cap onto the pole to make a tight fit.

Such wooden caps have several disadvantages. The most important disadvantage is the short life of the cap, which may only be avoided by frequent time-consuming maintenance such as cleaning and painting. Otherwise the weather will rapidly attack the wood to cause decay thereof. Another disadvantage is the easily occurring damaging in handling, particularly if the cap is not made of hard wood. For hoisting and lowering a flag there is usually a small pulley mounted to or near the cap and made of metal or hard plastic material and guiding the rope or halyard, to which the flag is suspended. Such pullies rapidly jam by corrosion of its spindle or other influences of the weather thereon.

It has thus been proposed to make such caps from metal parts, in which the cap may be hollow and in which one part thereof may be screwed onto the other to form a substantially closed body for the cap. Such known structures are, however, very expensive and are often open to corrosion dangers. It has thus also been proposed to make such caps from ceramic material, but this is only suited for caps of very small diameter, the caps are relatively heavy and will easily break.

This invention aims at obtaining an improved cap for a flag pole in view of the above disadvantages of known caps. To obtain these objects a cap for a flag pole as indicated in the preamble of this specification is according to the invention characterized in that the cap consists of moulded or cast material and is composed of two halves being substantially identical and secured to each other, said halves being substantially hollow and are bonded by their peripheral edges onto each other by an adhesive, by heat sealing, welding or soldering.

Thereby this cap is of simple structure, may be manufactured from easily mouldable materials, either metals or fibre reinforced synthetic materials and the like, by any suitable method such as injection moulding or die casting. The cap thus obtained has a long life, does not require maintenance and may be made easily in large series for low prices in any desired colour, the caps are highly resistant against corrosion and damages and also they allow a good and easy connection to flag poles of any material, also of synthetic resin or plastic material and aluminum.

According to a preferred embodiment of the invention the opening in the cap preferably is formed by an opening in the lower half, which extends entirely through this part and which merges into an opening in the upper half which is closed at its upper end, both openings converging upwardly by having a conical shape and in which the smallest diameter of the opening in the lower half is smaller than the widest diameter of the opening in the upper half, which is positioned in the area immediately adjacent to said smallest diameter of the opening in the lower half. So in this respect the parts are not fully identical, but this feature, being quite favourable for purposes to be described below, allows easy manufacture of upper and lower halves in the same external mould or die, where only a core has to be changed, reversed and be retracted somewhat when passing from the manufacturing lower halves to the manufacturing of upper halves of such caps.

Another point in which the halves need not be identical is with respect to the means for guiding the halyard for hoisting and lowering the flag, which means are not formed by a roller but by a dead-eye and by openings through the cap giving admission of the line or halyard to the dead-eye. Preferably this is embodied in such a way that the dead-eye and the openings are exactly the same in both halves of the cap so that in this respect the halves may remain identical.

For connecting the cap to a flag pole it is preferred to apply according to the invention a mounting or connecting element, which is embedded in the securing opening in the cap and it is preferred to fix this connecting element in said opening in the cap by means of material cast into said opening, e.g. a casting resin. Moreover, the connecting element may be secured by a part protruding from the cap by clamping or by connecting means to or into a flag pole, preferably into a hollow flag pole open at its top.

It is further envisaged that the connecting element is preferably made from strips welded to each other for the part within the cap and at a distance from each other at the outside of the cap. It is also possible to manufacture the connecting element from a tubular part, which is provided with axial cuts or parts milled away or removed in another manner, to obtain strip-shaped parts at least at one end of the tubular part which protrudes from the cap.

The invention will now be explained in more detail with reference to the enclosed drawings giving by way of embodiment only a cap with adjacent part of a flag pole in a preferred embodiment. In said drawings.

Figure 1:
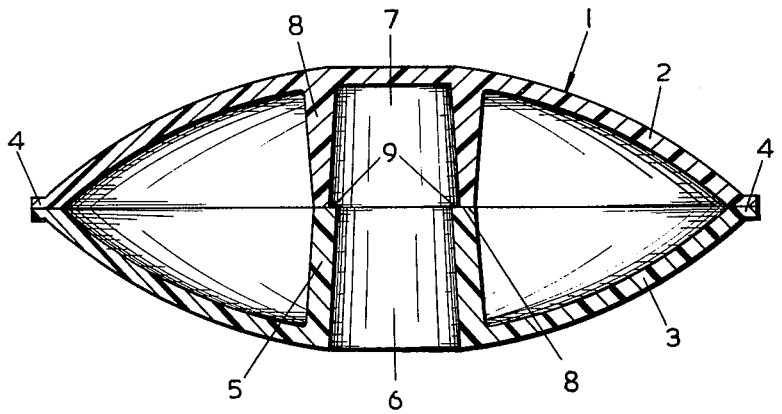
FIG. 1 shows a vertical section through a cap according to the invention.

In FIG. 1 the cap 1 consists of an upper half 2 and a lower half 3, which are bonded together by a suitable adhesive at least around their outer edge 4 in the plane perpendicular to the axis. The halves are preferably made from plastic or synthetic resin material by pressing or moulding, but may as well be made to advantage from other casting or injecton moulding material such as aluminium. The halves 2 and 3 are preferably hollow, so that the weight of the cap and the quantity of material necessary therefore is as low as possible. In the lower half 3 there is a central part 5 with a throughgoing opening 6, which merges into an opening 7 in the upper part having the same axis, said opening 7 being surrounded by a central wall 8 in said upper part 2 and being closed at its top. This closure takes care of avoiding rain and corrosive substances from entering the cap and thus entering the flag pole from above.

The halves 2 and 3 are preferably embodied substantially identically as is shown in FIG. 1, so that it is possible to manufacture both halves with the aid of one single die, in which it is only necessary, when manufacturing the halves, to use different mandrels or cores for the central opening 6 or 7. The openings 6 and 7 are slightly conical in the upward direction, the end or smallest diameter of the opening 6 (top face of part 3) being smaller than the inner diameter of the opening 7 in the lower surface of part 2. Thus, at the separating plane between the halves of the cap a circular collar or shoulder 9 is formed, which promotes an easy and intimate connection of the cap 1 to a flag pole as will be explained below. For bonding the two halves to each other it is possible, depending upon the materials used, e.g. to heat the upper half 2 in a furnace to a tempera ture of about 80° to 90°C. The lower half 3 is, on the top surface of the peripheral edge or flange 4, provided with an adhesive, e.g. a suitable polyester base glue, and through a simple centering annulus the halves may be centered onto each other. After curing of the glue there may be a protruding burr of adhesive outside the peripheral part 4 of the cap and this may be removed by e.g. grinding.

Figure 2:
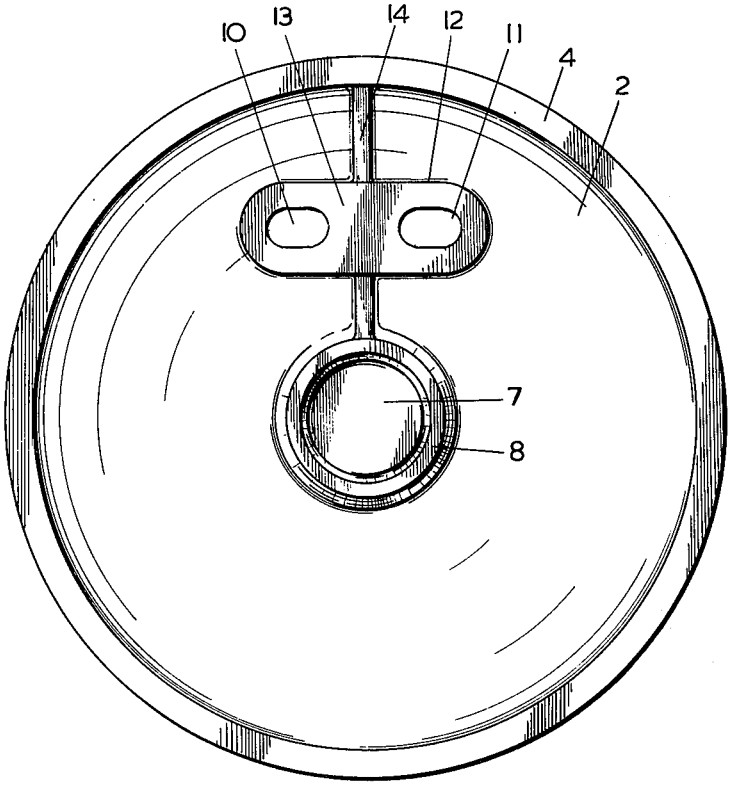
FIG. 2 shows a view from below of the upper half of the cap of FIG. 1.
Figure 4:
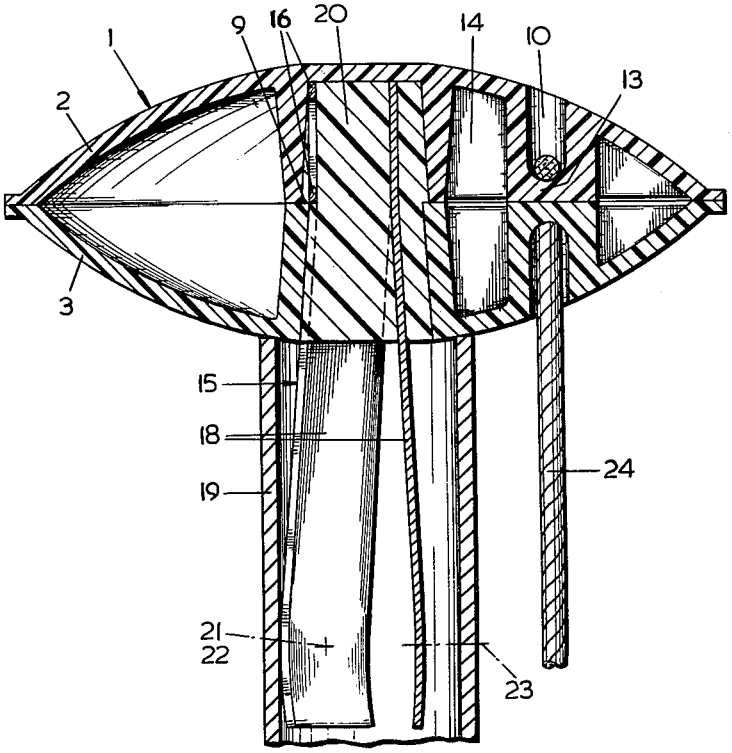
FIG. 4 shows a vertical section through the cap with the adjacent part of the flag pole and a connecting element for connecting the cap to the flag pole, in a section at right angles to the section of FIG. 1.

In FIG. 2, giving a view from below of the upper half 2, it will be seen that outside the central opening 7 there are two openings 10 and 11 and it will be clear from FIG. 4 that these protrude entirely through the said half. These openings are provided in a dam part 12 forming at the lower surface as seen in FIGS. 2 and 4 a dam 13 for guiding a halyard or rope for hoisting and lowering a flag. These openings 10 and 11 and parts 12 and 13 are identical for both halves, so that they may be made in the same die. The openings 10 and 11 and the dam or bridge 13 serve to replace the roller or pulley for the halyard in known flag poles. This structure is strong, simple and easy to manufacture. The dam or bridge 13 is rounded to avoid wear of the halyard.

Each half of the cap is provided with a reinforcing rib 14 extending as shown in FIGS. 2 and 4. If desired there may be more reinforcing ribs between the central parts 5 and 8 and the periphery of the cap.

Figure 3:
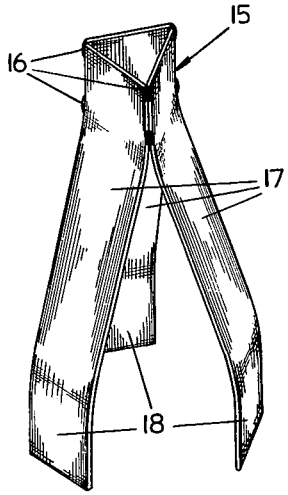
FIG. 3 shows a connecting element according to the invention.

FIG. 3 shows a connecting element 15, by which it is possible to mount the cap 1 to a hollow flag pole as shown in FIG. 4. The connecting element 15 consists preferably of three metal strips 17 welded together at 16 and having the lower ends 18 at a distance from each other. It is, however, also possible to make this connecting element from a tubular part, in which slits are made to form strips at least at one end of said tubular part where it has to protrude from the cap.

FIG. 4 shows a cap 1 according to the invention mounted by such a connecting element 15 to a hollow flag pole 19. The connecting element 15 is positioned with its narrower top end as shown in FIG. 3 in the central opening 6, 7, of the cap and thereupon the opening is entirely or substantially filled with a suitable casting material such as a casting resin. After curing of the casting material the connecting element 15 is rigidly connected to cap 1. The part of the connecting element 15 protruding from the cap is now positioned in the topend of the hollow flag pole 19, and it is possible to bend the strip ends 18 somewhat inwardly or outwardly to adapt them to different diameters of the inside of the flag pole. Preferably the strips 17 are bent outwardly sofar that the connecting element after sliding into the pole is clamped in position, the strip ends 18 exerting an outward force onto the inner wall of the flag pole 19. It is now easily possible if desired, to drill holes through the flag pole and the strips or such holes may be drilledbefore mounting the cap onto the pole and such holes may take up connecting means 21, 22 and 23 such as screws, bolts or rivets, for the rigid connection of the cap 1 to the flag pole 19. It is also possible to use welding in some cases. The collar 9 (FIG. 2) promotes the maintaining of the element 15 rigidly in the cap 1 in that the cured cast resin material 20 engages behind it. It is, however, also possible to embody the connecting element at its upper end so as to have mechanical means engaging behind said shoulder 9 to promote the good mutual connection, such as e.g. by separate strip parts protruding outwardly and being somewhat resilient to pass the narrowest part of opening 6 and to spring outwardly to engage the shoulder 9.

Through the openings 10 and 11 (vide also FIG. 2) a halyard 24 is guided over bridge part or dead-eye 13. By the round shape of the bridge part 13 it is possible to move the halyard 24 easily and substantially without wear, for hoisting and lowering the flag.

It will be clear, although a preferred embodiment of such a cap according to the invention has been shown, that the invention may be realized in somewhat different ways. e.g. there may be a connecting element such as 15 which does not engage the inside but the outside of the flag pole, so that the cap may also be used for massive flag poles such as of wood.

On the other hand, if there is a wooden flag pole, it is also possible to omit the connecting element 15 entirely, to give the pole a pointed top part and to mount the cap thereon in that the pointed top part enters the openings 6 and 7. The connecting element 15 has, however, among others the advantage that it is easily adapted to flag poles of different type and diameters, without the necessity to make the cap and the internal openings to very accurate tolerances.

Of course it is also possible to apply a sealing layer between the top edge of the hollow flag pole and the cap, such layer avoiding the entrance of moisture and other corrosive substances. It is possible to use an elastic material as such a sealing layer, e.g. in the shape of a ring.

I claim:

1. A cap for a flag pole, which cap is provided with an opening for the mounting thereof onto the flag pole, characterized in that the cap consists of moulded or cast material and is composed of two halves which are substantially identical and are secured to each other, said halves being substantially hollow and being bonded by their peripheral edges to each other, along a surface perpendicular to the axis of the cap, the opening being positioned in the lower half of the cap and giving access to the interior of an axially-extending sleeve-like part centrally positioned within the hollow cap; said sleeve-like part extending entirely through said lower half and merges into an opening in a sleeve-like part in the upper half which sleeve-like part is closed at its upper and, and wherein both sleeve-like members converge upwardly by having a frusto-conical shape and in which the smallest diameter of the opening in the lower half is smaller than the widest diameter of the opening in the upper half, which is positioned in the area immediately adjacent to said smallest diameter of the opening in the lower half.

2. A cap according to claim 1, characterized in that the bordering plane between the halves of the cap there is a dead-eye between upstanding walls in each half, said walls bordering an opening adapted to take up a rope for a flag to be guided over the dead-eye, said dead-eye and walls being identical for the two halves.

3. A cap according to claim 1 characterized in that a connecting element projects outwardly from the cap towards the flag pole and is fixedly mounted in said opening by means of material cast into said sleeve.

4. A cap according to claim 3 characterized in that the connecting element is made from strips welded together in a part of it lying within the cap and at a distance from each other in a part of it outside the cap.

5. A cap according to claim 3 characterized in that the connecting element consists of a tubular part, which is provided with axial cuts to form strip-shaped parts in the part of the element that projects outside the cap.

6. A cap for a flag pole, which cap is provided with an opening for the mounting thereof onto the flag pole, characterized in that the cap consists of moulded or cast material and is composed of two halves which are substantially identical and are secured to each other, said halves being substantially hollow and being bounded by their peripheral edges to each other in a plane perpendicular to the axis of the cap, and in that in a centrally positioned mounting sleeve in the cap, a connecting element is fixedly secured and projects from the cap towards the flag pole, said connecting element being made from strips welded together in a part of it lying within the cap, and at a distance from each other in a part of it outside the cap, and being fixed into said opening by means of material cast into said sleeve.

7. A cap for a flag pole, which cap is provided with an opening for the mounting thereof onto the flag pole, characterized in that the cap consists of moulded or cast material and is composed of two halves which are substantially identical and are secured to each other, said halves being substantially hollow and being bonded by their peripheral edges to each other in a plane perpendicular to the axis of the cap, and in that in a centrally positioned mounting sleeve in the cap, a connecting element is fixedly secured and projects from the cap towards the flag pole, said connecting element having a tubular part, which is provided with axial cuts to form strip-shaped parts in the part of the element that projects outside the cap, and being fixed into said opening by means of material cast into said sleeve.

* * * * *